US005333961A

United States Patent [19]

Capigatti et al.

[11] Patent Number: 5,333,961

[45] Date of Patent: Aug. 2, 1994

[54] KEYBOARD WITH TOP MOUNTABLE KEY CAP ASSEMBLIES AND METHOD

[75] Inventors: Andrew C. Capigatti, Winfield; John M. Zdenek, Riverside, both of Ill.

[73] Assignee: Rockwell International Corporation, El Segundo, Calif.

[21] Appl. No.: 926,064

[22] Filed: Aug. 5, 1992

[51] Int. Cl.[5] ..... B41J 5/12

[52] U.S. Cl. ..... 400/490; 400/472

[58] Field of Search ..... 400/490, 493.2, 495, 400/495.1, 472

[56] References Cited

U.S. PATENT DOCUMENTS

| | | | |
|---|---|---|---|
| 3,489,342 | 5/1968 | Anderson | 400/490 |
| 3,982,081 | 9/1976 | Demler, Jr. | 400/495 |
| 4,363,942 | 12/1982 | Deeg et al. | 400/495 |
| 5,172,990 | 12/1992 | Weng | 400/490 |

OTHER PUBLICATIONS

"Reduced Noise Keybutton", IBM Technical Disclosure, vol. 31 No. 11 Apr. 1989, pp. 43–44.

"Changeable Key Pad Overlay and Key Pad Panel", IBM Technical Disl. Bulletin vol. 29, No. 5, Oct. 1986, pp. 2199–2000.

Cooper et al., "Changeable Array Keyboard", IBM Technical Disclosure Bulletin vol. 11, No. 5, Oct. 1968, p. 524.

"Low Cost Versatile Control Panel", vol. 28, No. 7, Dec. 1985, pp. 2948–2949 IBM Technical Disclosure Bulletin.

*Primary Examiner*—Edgar S. Burr
*Assistant Examiner*—Anthony H. Nguyen
*Attorney, Agent, or Firm*—C. B. Patti; H. F. Hamann

[57] ABSTRACT

A keyboard assembly (12) of a telephonic console (14) having multiple modes of operation programmable at a user's site is shipped partly disassembled from a plurality of top mountable key caps with different designations for the same key location corresponding to different modes for permanent top mounting into vacant key holes (18, 20, 22, 24) at the customer site and is preassembled with other key cap assemblies that are installed at a manufacturing site from the underside (12') of the keyboard. The top mountable key cap assemblies (40) have a plurality of resilient arms (56, 58, 62, 64) with flanges (68) on the ends to block removal and wedge-shaped camming surfaces (70, 72) for camming engagement with the sides (50) of key holes to resiliently press the flanges (68) inwardly to enable insertion into the key hole (18, 20, 22, 24) mounted beneath the underside (12') of the keyboard (12) at which location they resiliently return to a locking position (FIG. 4 B) to block removal. A protuberance (48) around the key hole side wall (50) sealingly, slideably mates with a curtain wall (46) of the cap assembly (40) to block entry of fluids and dust into the interior of the keyboard assembly.

18 Claims, 3 Drawing Sheets

KEYBOARD WITH TOP MOUNTABLE KEY CAP ASSEMBLIES AND METHOD

BACKGROUND OF THE INVENTION

1. Field of the Invention

This invention relates generally to electronic keyboards and associated key cap assemblies and methods of assembling keyboards and, more particularly, to key cap assemblies and methods of permanently mounting key cap assemblies for sliding movement within key holes of a keyboard.

2. Description of the Related Art Including Information Disclosed Under 37 C.F.R. 51.97-1.99

Electronic keyboard assemblies of the type having a planer array of key switches overlain by an associated array of key holes of a keyboard are well known.

Key cap assemblies are mounted for limited sliding movement within the mating key holes to engage and actuate the key switches. The key switches are temporary contact switches that are spring biased to raise a switch actuator and associated key cap assembly to a home position after being released.

The key cap assemblies have a cap which bears a number letter, word or other designation or indicia identifying to the user the function performed in response to actuation of the key. Sometimes the same key switch and its key hole location are associated with different functions and thus require key cap assemblies with different indicia.

It is important that indicia on the key cap assemblies is durable and that the mounting of all key cap assemblies within their related key holes is permanent (i.e. the key cap assemblies can be readily removed by the user from the top of the keyboard only with special tools, not provided, if at all. ) Otherwise, the indicia for a given function can be obscured or lost from wear, or the key cap assemblies can become lost, stolen for purposes of gain, or worse, exchanged for key cap assemblies with incorrect indicia for purposes of sabotage or by mistake by unauthorized personnel.

In known keyboards, all the key cap assemblies are bottom mountable only and must all be inserted into their associated key holes from the bottom of the keyboard. A fixed nonmovable collar or other fixed blocking mechanism is provided to engage with the bottom of the keyboard and thereby permanently prevent removal from the top of the keyboard. The same fixed collar prevents all the key cap assemblies of the keyboard from being installed from the top of the keyboard. Disadvantageously, once the key cap assemblies are inserted into the keyboard at the manufacturing facility, and the housing is closed, the key cap assemblies are permanently set into place. The key cap assemblies with fixed blocking mechanisms cannot be removed or installed without disassembling the housing, and thus the key cap assemblies and the designations they carry cannot be readily changed at the customer site.

Many devices which employ keyboards perform different functions in different ways depending on how they are programmed. For example, activation of a given key may cause a message to be recorded if activated when the keyboard device is in one program mode, while activation may cause a message to be played back when the device is programmed in a different mode. Thus, while the physical layout of the keyboard remains the same, indicia of the cap (i.e. "record" or "play") must change depending upon which function the particular key is to perform when actuated.

Often, the particular function for a given key is not known until the device is installed at the customer site or needs to be changed after initial installation. Unfortunately, since known permanently installed key cap assemblies can be inserted only at the manufacturing facility, the only way in which key cap assemblies have been permanently installed is by installing all of them at the manufacturing facility by inserting them into the key holes from the bottom of the keyboard. None are permanently installed at the customer site, and if it is desired to change a key cap assembly after delivery to a user site, the entire keyboard must be returned to a remote facility equipped to open the housing and disemble the entire keyboard from the key switch array.

While there are known key cap assemblies which are not permanently mounted and can be removed and reinserted from the top of the keyboard, they leave open space between the cap assembly and the key holes with which they are mated and thus, render the components within the keyboard housing susceptible to damage by dust, dirt, water or other debris.

SUMMARY OF THE INVENTION

Accordingly, it is the principal object of the present invention to provide a keyboard, key cap assembly and method in which top mountable key cap assemblies are provided to enable permanent key cap installation at the user site without removal of the keyboard housing or other disassembly of the keyboard.

This objective is achieved in part by providing a key cap assembly for slidable connection within the sides of a key hole of a keyboard with a cap having opposite sides, at least two opposed movable arms respectively extending from the two opposite sides of the cap to distal ends, and flanges carried at the distal ends of the movable arms for blocking engagement with the keyboard to prevent separation of the cap from the keyboard.

In the preferred embodiment, another two opposed arms with flanges spaced from the two opposed arms and respectively extending from each of the two opposite sides of the cap are additionally provided, so that a special tool is required to move both arms simultaneously to unlock the key cap assembly from the keyboard.

Preferably, the arms are made of resilient material to resiliently press the sides of the key hole when inserted therein, and the top mountable key cap assembly includes camming surfaces respectively carried by the movable arms adjacent the flanges to facilitate insertion of the arms into the top of the key hole from above the keyboard.

The objective is further achieved by a method of making a keyboard having a keyboard with a bottom and top and a plurality of key holes extending between the bottom and the top for slidable receipt of a plurality of slidably mounted key cap assemblies, comprising the steps of (1) preinstalling some cap assemblies by inserting them into their associated key hole from the bottom of the keyboard while at a manufacturing facility, and (2) permanently installing other top mountable cap assemblies which carry means blocking removal from the top of the keyboard by inserting them into their associated key holes from the top of the keyboard while at a site of a user of the keyboard. The preferred method also includes the steps of (3) transporting to a user a plurality of the top mountable key cap members for at least one vacant key hole not having one of the cap assemblies preinstalled at the manufacturing facility, (4) selecting at the user site which one of the plurality of top mountable key caps is to be installed into the empty key hole based upon which functions selected at the user site are to be performed by the keyboard and (5) permanently mounting the selected one of the plurality of top mountable key cap members at the customer site by inserting the selected one into the top of the vacant key hole.

The top mountable keys can be mounted from the bottom, but less expensive key cap assemblies without movable arms are preferably mounted within the key holes which are associated with only one function. Thus, the object is also achieved in part by a keyboard assembly having a keyboard with a plurality of key holes extending between a top and a bottom of the keyboard, a group of top mountable key caps with means for permanently mounting them to the keyboard by insertion into a keyhole from the top installed within some of the plurality of keyholes and another group of bottom mountable cap assemblies with means for permanently mounting them to the keyboard by insertion into a keyhole only from the bottom installed within others of the plurality of keyholes.

Preferably the key holes have a sidewall and a sealing protuberance extends away from the sidewall for making sealing engagement with the key cap assemblies to prevent fluids and dust to enter into the interior of the keyboard assembly.

The foregoing objects and advantageous features of the invention will be explained in greater detail and others will be made apparent from the detailed description of the preferred embodiment of the present invention which is given with reference to the several figures of the drawing, in which:

DESCRIPTION OF THE PREFERRED EMBODIMENT

Figure 1:
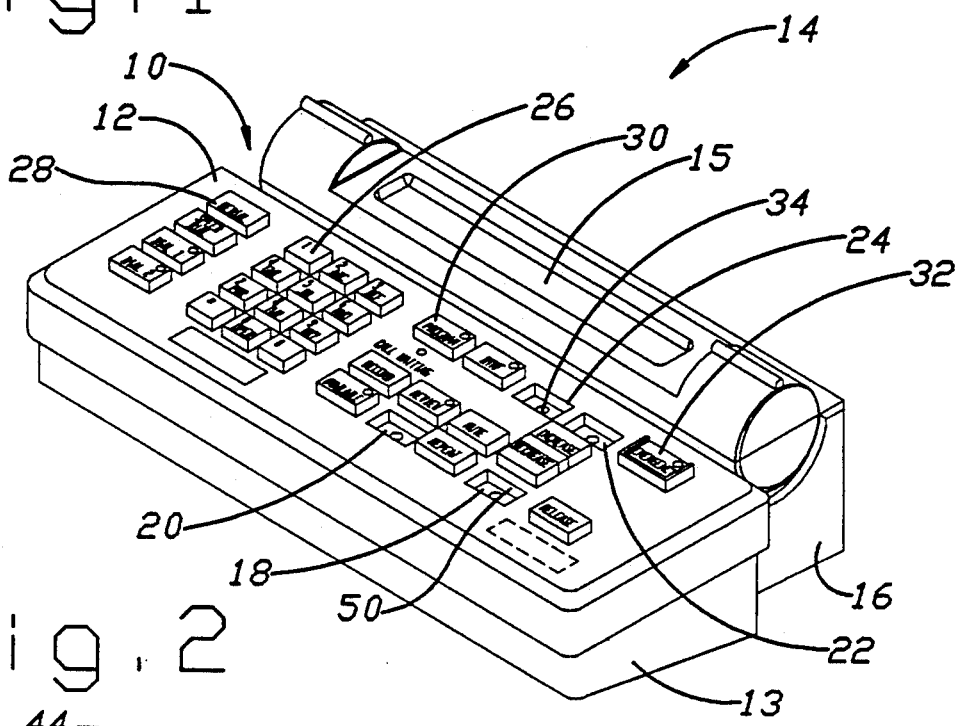
FIG. 1 is a perspective view of a preferred embodiment of the keyboard assembly of the present invention as employed with a telephonic console in which some of the top mountable key cap assemblies have not yet been installed in some vacant key holes.

Referring now to FIG. 1 of the drawings, the keyboard assembly 10 of the present invention is seen to have a keyboard 12 mounted atop a keyboard housing 13. Protectively contained within the key hole housing 13 is an array of momentary contact key actuator switches 34 which respectively overly all the key holes and other electronics used to operate the console 14. The keyboard assembly 10 is associated with a telephonic console 14 having a liquid crystal display 15 mounted to a display base 16. A telephone head set (not shown) connects with the console 14 to enable a user or operator, to have voice communication with incoming callers. The keyboard assembly 10 enables the operator to communicate with a host computer, a self-contained microprocessor, or both, to perform a variety of functions. In an automatic call distribution system, the console 14 is capable of being used as an agent console, a supervisory console or in other capacities. Each of these modes of operation have certain functions and characteristics in common and others of which are unique and require different functions associated with the same keys. The changes to the console to cause them to operate in different modes with different corresponding functions and characteristics are readily performed by an installer on site, usually by way of software programming changes accessed by a special code known only to the installer.

However, such installers are not equipped by training or otherwise to disassemble the keyboard 12 from the keyboard housing base. Accordingly, in keeping with the present invention the consoles 14 and their associated keyboard assemblies are shipped with the key holes associated with different functions which depend upon which operating mode that is selected for them on site, such as keyholes 18, 20, 22 and 24, vacant. Other key cap assemblies, such as key cap assemblies 26, 28, 30 and 32 are installed at the place of manufacture in the other key holes, like key hole 24, whose function or designation does not vary depending upon the mode of operation which is selected for the console 14.

Figure 2:
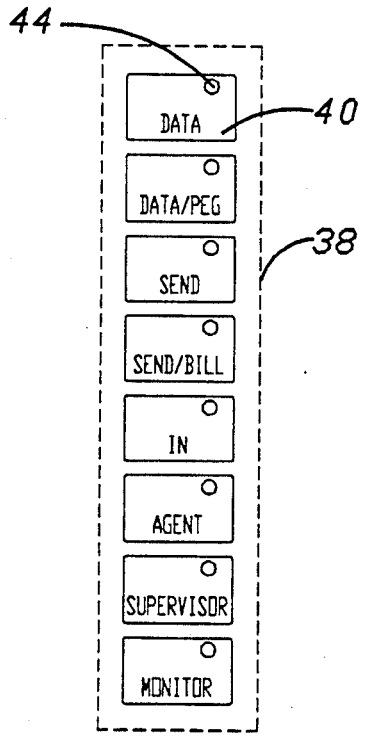
FIG. 2 is a plan view of a set of top mountable key cap assemblies of the present invention from which selected ones are inserted into the vacant key holes from the top of the keyboard of FIG. 6 at the customer site according to the preferred method of assembly.

A set 38 of two or more top mountable key cap assemblies 40 of the present invention, shown in FIG. 2, are shipped with or otherwise provided with the console 14. In accordance with the method of the present invention, selected ones of the top mountable key cap assemblies 40 are installed by inserting only the key cap assembly 40 in each vacant key hole 18–24 which corresponds to the function selected for the associated key hole, as determined by the mode of operation in which the console is placed at the user site. For instance, if the console 14 is programmed at the user site to function in the agent mode, then top mountable key cap assemblies 40 of FIG. 2 labelled "Data," "Send," "In," and "Supervisor" are top loaded into appropriate ones of key holes 18–24. On the other hand, if the console is selected to operate as a supervisory unit the cap assemblies 40 of FIG. 2 labelled "Data/Peg," "Send/Bill," "Agent" and "Monitor" are installed in the appropriate ones of vacant key holes 18–24 of the keyboard assembly 10 of FIG. 1 in lieu of the appropriate key cap assemblies 40 noted above for agent console use.

Figure 3A:
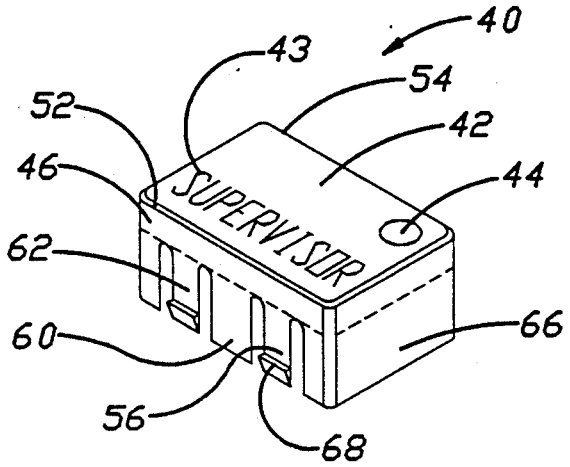
FIG. 3A is a perspective view of one of the key cap assemblies of FIG. 2.
Figure 3B:
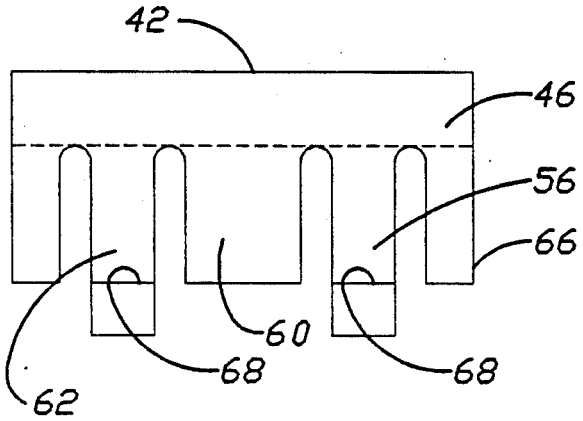
FIG. 3B is a front view of one of the key cap assemblies shown in FIG. 3A.
Figure 3C:
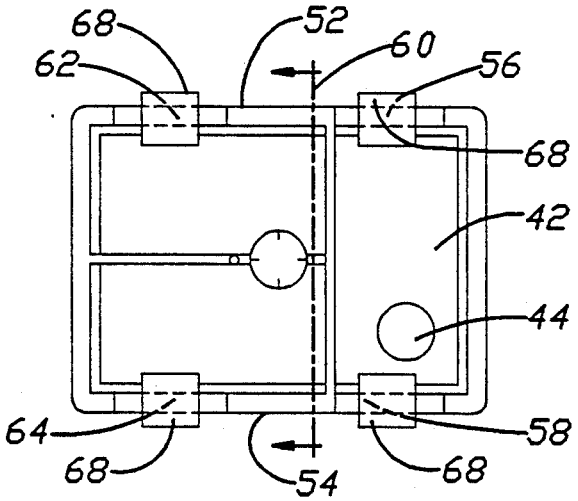
FIG. 3C is a bottom view of one of the key cap assembly of FIG. 3A.

Turning now to FIGS. 3A, 3B, and 3C of the preferred embodiment of the top mountable key cap assembly of the present invention is seen to have a substantially planer, rectangular cap, or top 42, bearing an indicia 43 of its associated function, such as "Supervisor," in contrasting color, and a translucent lens 44 for passing light from an indictor lamp (not shown) located beneath it adjacent the key switch 34. Extending around the rectangular periphery of the cap 42 is a curtain wall 46 which, as will be explained with reference to FIGS. 4A and 4B, provides a smooth mating surface for sealed, sliding engagement with a sealing protuberance 48 around the side walls 50 of the associated key holes to block entry of liquids, dust, etc. within the keyboard housing.

Beneath and uniformly extending from the bottom of the curtain wall 46 on the opposite longitude sides 52 and 54 of the cap 42 are respectively located two spaced, substantially parallel, movable legs 56 and 58. The two opposed parallel legs 56 and 58 extend as a smooth extension of the curtain wall 46 and are preferably integrally formed therewith. Preferably, a second pair of movable legs 62 and 64 are also mounted to curtain wall 46 at sides 52 and 54, respectively, which are parallel to and spaced from legs 56 and 58, respectively. A smooth intermediate extension 60 of the curtain wall 46 extends between each of the pairs of legs 56, 62 and 58, 64 for improved structural rigidity. Each one of the pair of relatively narrow opposite sides of the cap 42 also has a continuous end extension 66, which is coextensive with the full length of the legs 56, 58, 62 and 64 and the intermediate extensions 60.

At the distal ends of each of the opposed pairs of arms 56, 58 and 62, 64 is a flange 68 which extends outwardly from its associated arm in a direction substantially parallel to cap 42 and, thus, transverse to the elongate direction of the arms. These flanges 68, when located beneath the underside 12' of the keyboard 12, seen in FIGS. 4A and 4B, bear against the underside 12' adjacent the associated keyhole to block sliding removal of the top mountable key cap assembly 40 from without the top of the keyboard 12.

Figure 4A:
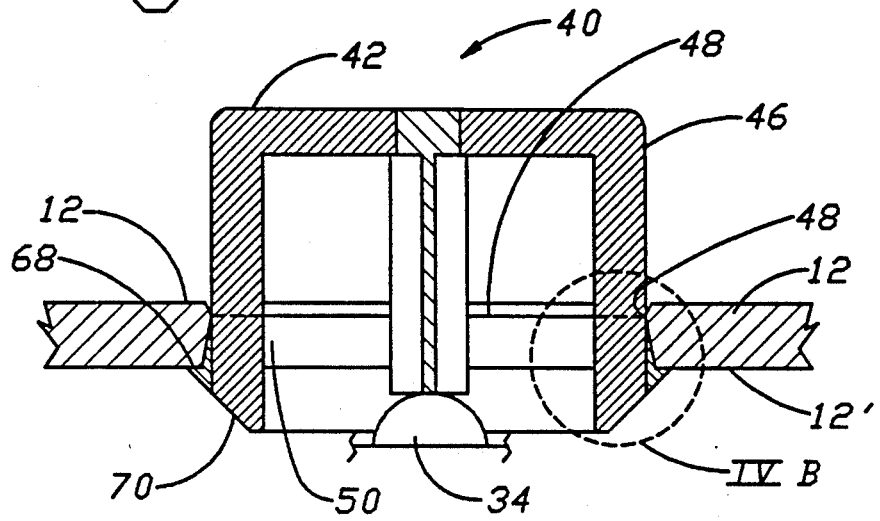
FIG. 4A is a cross sectional side view taken along section line IVA of FIG. 3C.
Figure 4B:
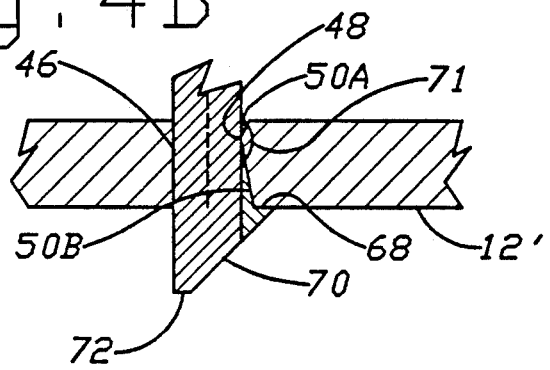
FIG. 4B is an enlarged view of the encircled section IVB of FIG. 4A.

Referring to FIGS. 4A and 4B, the flanges 68 are located adjacent to and above a wedge-shaped camming surface 70 which has its narrowest dimension at the most distant end 72 and its widest dimension merging into the flange 68.

The arms 56, 58, 62 and 64 are mounted for movement relative to the curtain wall 46. Preferably the arms are flexible and are preferably made of resilient material, such as resilient plastic, for this purpose. Alternatively, the arms are otherwise caused to move to their locked positions as shown in FIGS. 4 and 4B by a spring or other suitable resilient member. Because of the blocking action of flanges 68, once the movable arms 56, 58, 62 and 64 are fully inserted into the key hole, the key cap assembly 40 is permanently installed, in the sense that it can only be removed from the top of the keyboard, if at all, through use of a special tool to simultaneously press inwardly both arms on each side 52 and 54 to clear the flanges 68 past the bottom edge of the keyhole for removal.

Because of the wedge-shaped camming surface 70, when the end 72 of the camming surface 70 is slid into the key holed the edge of the sides 50 of the key hole press against the camming surface 70 and thus inwardly press the associated movable arms. The camming surface 70 moves downwardly along the sides 50 of the key hole until the flange 68 is beneath the keyboard underside 12'. Because the arms 56, 58, 62 and 64 are resilient or biased to return to the locked position once the flange 68 rides beneath the underside 12' of the keyboard, the inward force is removed, and the arm resiliently returns to the blocking position shown in FIG. 4B. In the blocking position the flange 68 is perpendicularly aligned with the cap 42 and is blocking the path of sliding movement of the key cap assembly 40 through the key hole to prevent its removal from the top.

Still referring to FIG. 4B, as noted above, a protuberance 48 makes mating sealing engagement with the sides of the curtain walls 46 to protectively seal the key holes against water, dirt or other contaminants in between keyboard 12 and keyboard base 13. Preferably, the sealing protuberance 46 is formed by canted wall sections 50A and 50B of side walls 50, which meet each other at an angle 71 of approximately 178 degrees.

Figure 5:
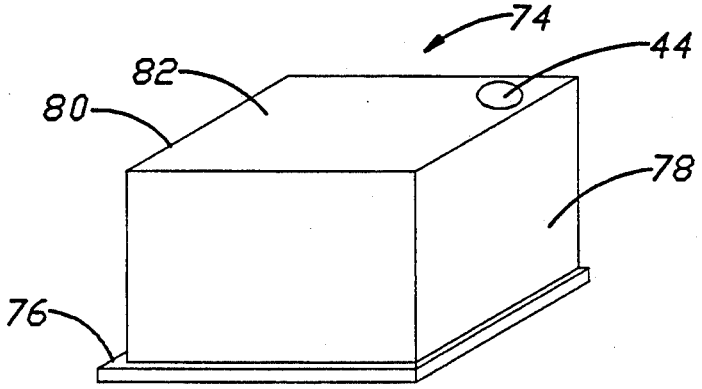
FIG. 5 is a perspective view of a bottom mountable key cap assembly preferably employed in conjunction with the top loadable key cap assemblies of FIGS. 3A–4B in the keyboard of FIG. 1 at keys whose function does not change.

Referring to FIG. 5, preferably for purposes of economy, the keyboard assembly 12 has only the top mounted key cap assemblies 40 mounted from the top of the keyboard at the user site, even though all the top mountable key cap assemblies 40 are capable of being mounted from the bottom of the keyboard.

Instead of top mountable key cap assemblies 40 being installed at the factory in key holes which are common to all the different modes of operation of the console 14, bottom loading key caps 74 are installed. As seen, the bottom loading key cap assembly 74 like the top mountable key cap assembly 40, has a flange 76 and a curtain wall 78 extending from the sides 80 of a cap 82 but lack movable arms required for top loading. The cap assemblies 74 are not capable of being mounted from the top of the keyboard 12 and are all mounted from the bottom of the keyboard at the factory or other place equipped for regular assembly.

While a detailed description of the preferred embodiment of the invention has been given, it should be appreciated that many variations can be made thereto without departing from the scope of the invention as set forth in the appended claims. For instance, although the keyboard 12 is shown in connection with a telephone console 14, it can be used also with other equipment requiring a keyboard with variable functions programmable for different keys.

We claim:

1. A keyboard assembly, comprising:
a keyboard having a key hole with a sidewall having an inwardly protuberant edge; and
a key cap assembly including
a cap with a curtain wall for sealing, sliding engagement with the inwardly protuberant edge and having two opposite sides,
at least two opposed movable arms defined by extensions of the two opposite sides of the curtain wall with distal ends spaced from the cap, and
flanges carried at the distal ends of the movable arms extending outwardly away from the sides and the arms for blocking engagement with the keyboard to prevent separation of the cap from the keyboard.

2. The key cap assembly of claim 1 including another two opposed arms with flanges spaced from the two opposed arms and respectively extending from each of the two opposite sides of the cap.

3. The key cap assembly of claim 1 in which
the movable arms are elongate, and
the flanges extend from the movable arms in a direction substantially transverse to the elongate direction of the movable arms.

4. The key cap assembly of claim 1 in which the arms are made of resilient material to resiliently return to alignment with the sides of the cap after removal of any displacement force.

5. The key cap assembly of claim 1 including camming surfaces respectively carried by the arms adjacent the flanges to facilitate insertion of the arms into the key hole from above the keyboard.

6. The key cap assembly of claim 5 in which the camming surfaces are wedge-shaped, being beveled from a relatively narrow dimension nearest the distal ends of the arms to a relatively larger dimension adjacent to the flange.

7. The key cap assembly of claim 1 in which
the cap has a generally planar surface, and
the curtain wall substantially surrounds the cap and extends in a direction substantially transverse to the planar surface for making sliding engagement with the key hole.

8. The key cap assembly of claim 7 in which the arms extend from, and in general alignment with, the curtain wall.

9. The key cap assembly of claim 7 in which
the arms have a flexed state and a nonflexed state, and
the flanges extend outwardly from the curtain wall when the arms are in a nonflexed state.

10. The key cap assembly of claim 1 including
means for applying a force to the arms to flex them to a position in which the flanges are aligned with the curtain wall to enable insertion into the top of the keyhole; and
means for automatically returning the arms to a nonflexed position when the force is removed in which the flanges are in blocking relationship with the key hole to prevent removal from the top of the key hole.

11. The key cap assembly of claim 10 in which the automatically returning means includes resilient material from which the arms are made.

12. The key cap assembly of claim 1 in which the cap is rectangular.

13. The key cap assembly of claim 1 in which the cap, arms and flanges are integrally formed together from plastic-like material.

14. A keyboard assembly, comprising:
a keyboard having a plurality of key holes with sidewalls extending between a top and a bottom and a sealing protuberance extending around the sidewalls;
a group of top mountable key cap assemblies, with means for permanently mounting each of them in sealed, sliding engagement with the sealing protuberance within associated ones of the key holes of the keyboard by insertion into a key hole from the top, installed within some of the plurality of the key holes; and
another group of bottom mountable key cap assemblies, with means for permanently mounting them to the keyboard by insertion into an associated key hole only from the bottom into sealed sliding engagement with the sealing protuberance within others of the plurality of key holes, all said key holes and sealing protuberances being sized to snugly fit with both the top mountable key assemblies and the bottom mountable key cap assemblies for sealing, sliding engagement therewith.

15. The keyboard assembly of claim 14 in which
the top mountable key cap assemblies have spring loaded flanges which snap to a blocking position relative to the keyboard after top insertion into the keyhole to prevent removal from the top of the keyboard, and
the bottom mountable key cap assemblies have nonmovable flanges that block the removal from, and insertion into, key holes from the top at the keyboard.

16. The keyboard assembly of claim 15 in which the spring load flanges as are at the ends of resilient arms of the top mountable key cap assemblies.

17. The keyboard assembly of claim 14 in which both the top mountable key assemblies and the bottom mountable key cap assemblies have a cap and a peripheral curtain wall for extending into the keyhole to make slidable sealing engagement therewithin.

18. The keyboard assembly of claim 14 in which the sealing protuberance is defined by a pair of inwardly canted wall surfaces respectively extending from the top and bottom of the sidewall to join together at an edge to form the sealing protuberance.

* * * * *